United States Patent [19]

Gillis

[11] Patent Number: 4,706,696

[45] Date of Patent: Nov. 17, 1987

[54] ORBIT TENT

[76] Inventor: Robert E. Gillis, P.O. Box 67, Aptos, Calif. 95003

[21] Appl. No.: 819,368

[22] Filed: Jan. 16, 1986

Related U.S. Application Data

[63] Continuation of Ser. No. 639,689, Aug. 10, 1984, abandoned.

[51] Int. Cl.[4] ..... E04H 15/04; E04H 15/28; E04H 15/44

[52] U.S. Cl. ..... 135/102; 135/98; 135/106

[58] Field of Search ..... 135/100, 101, 102, 104, 135/105, 106, DIG. 5, DIG. 9, 905

[56] References Cited

U.S. PATENT DOCUMENTS

| | | | |
|---|---|---|---|
| 840,483 | 1/1907 | Earnshaw | 135/102 X |
| 2,543,684 | 2/1951 | Blanchard | 135/104 X |
| 2,646,057 | 7/1953 | Blanchard | 135/104 X |
| 3,223,098 | 12/1965 | Dole, Jr. | 135/104 |
| 3,269,398 | 8/1966 | Holbitz | 135/102 |
| 3,424,178 | 1/1969 | Yazaki | 135/119 X |
| 3,834,410 | 9/1974 | Leibel | 135/104 |
| 3,838,703 | 10/1974 | Zeigler | 135/102 X |
| 3,968,808 | 7/1976 | Zeigler | 135/102 X |
| 4,078,572 | 3/1978 | Moss | 135/102 X |
| 4,236,543 | 12/1980 | Moss | 135/105 X |
| 4,265,259 | 5/1981 | Gillis | 135/104 |
| 4,265,260 | 5/1981 | Gillis | 135/104 |

FOREIGN PATENT DOCUMENTS

| | | | |
|---|---|---|---|
| 7708497 | 2/1978 | Netherlands | 135/105 |

*Primary Examiner*—Robert A. Hafer
*Assistant Examiner*—D. Neal Muir

[57] ABSTRACT

A tent is provided wherein a membrane is primarily kept under tension by a plurality of stressed poles wherein at least two sets of poles are used, radiating from at least two independent spaced points.

10 Claims, 6 Drawing Figures

ORBIT TENT

This application is a continuation, of application Ser. No. 06/639,689 filed Aug. 10, 1984 now abandoned.

SUMMARY OF THE INVENTION

The present invention relates to an improved tent of the type wherein a membrane is kept under tension by a plurality of stressed arcuate poles, particularly a tent such as that shown in my prior U.S. Pat. No. 4,265,259. According to the present invention, at least two sets of poles are employed which radiate from independent hubs which are spaced and which hubs are not connected by poles. At least three poles radiate from each hub and at least some of the poles cross each other.

The primary advantage of the present invention over prior art tents is that the tent is very easy to set up and is extremely strong considering the minimum number of poles which are used.

The radiation of poles from a single point was previously known; the tent of the present invention differs from such prior art tents in that it employs at least two independent hubs from which the poles radiate. In its simplest form, the tent of the present invention employs two hubs and three poles radiate from each hub. If one employed a single hub with all six poles radiating from the hub, the tent would have less strength since the individual panels between poles would be larger and there is no cross-bracing.

In accordance with one embodiment of the invention, sectioned poles are used with an elastic cord extending the length of each of the poles, greatly speeding up erecting the tent and taking it down.

Thus, the present invention provides a cross-braced tent with a minimum number of poles and with a minimum individual panel area for a given number of poles.

It is a primary object of the present invention to provide a tent which is easy to set up, which employs cross-bracing and has the maximum strength considering the number of poles employed.

Other aspects will appear from the balance of the specification.

BRIEF DESCRIPTION OF THE PREFERRED EMBODIMENT

Figure 1:
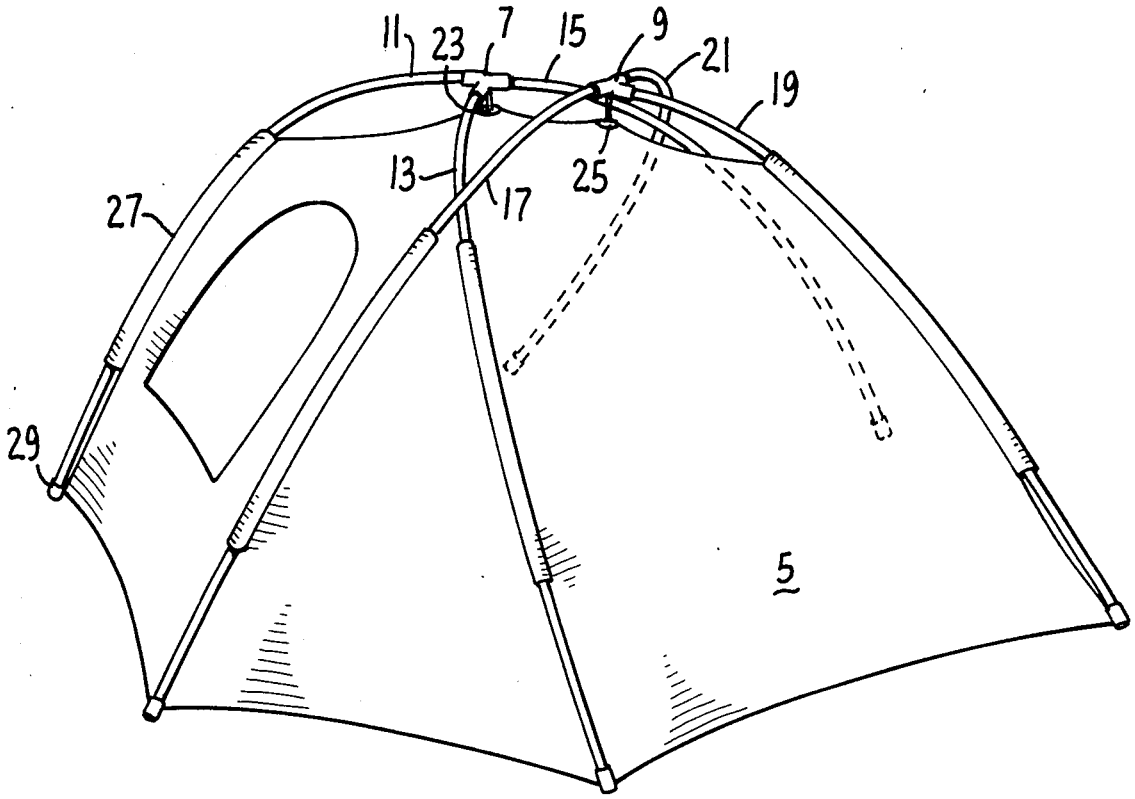
FIG. 1 is a perspective view of a tent embodying the present invention.

Referring now to the drawings by reference characters, there is shown a tent having a membrane 5 which can be any of the usual tent materials.

Figure 2:
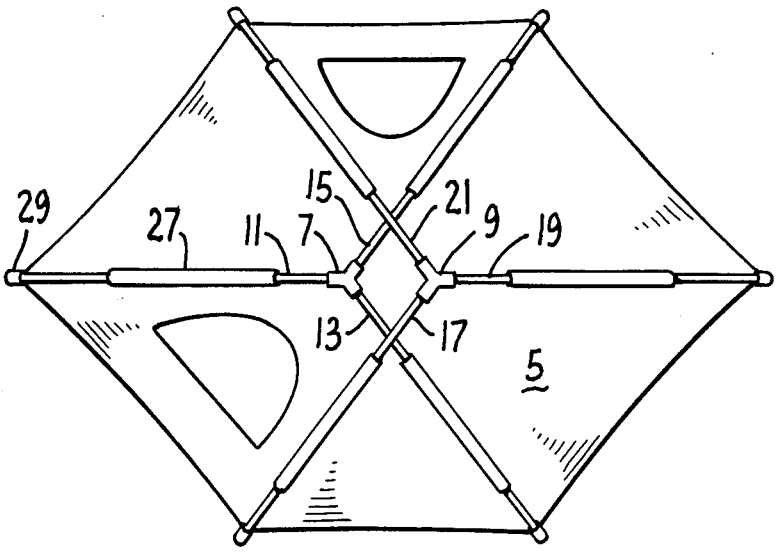
FIG. 2 is a plan view of the tent shown in FIG. 1.

In the embodiment shown in FIGS. 1 and 2, two radial hubs designated 7 and 9 are employed, each of which has sockets for the reception of three poles.

Thus, poles 11, 13 and 15 fit into hub 7 while poles 17, 19 and 21 fit into the hub 9. Each of the poles forms a sliding fit with one of the sockets of the hubs and each is held in place solely or at least primarily by tension on the membrane of the tent. The hubs are connected to the membrane 5 by the clips 23 and 25. These are preferably of the type shown in my prior U.S. Pat. No. 4,308,647.

Each of the poles passes through an envelope attached to the membrane so that pole 11 passes through the envelope 27 and so on. The envelopes do not go completely to the bottom of the membrane and the bottom of the membrane is provided with sockets 29 into which the terminal ends of the poles fit.

It will be noted that the membrane forms a sole point of connection between the hubs 7 and 9 and also forms the sole connection of the terminal ends of the poles. Further, it will be noted that the tent is entirely self-supporting and is not necessarily staked or otherwise fastened to the ground.

It will be seen that hubs 7 and 9 are spaced from each other with at least two of the poles crossing poles on the opposite hub. Thus, poles 13 and 17 cross and 15 and 21 cross. This provides for cross-bracing and maximum strength of the structure.

Figure 3:
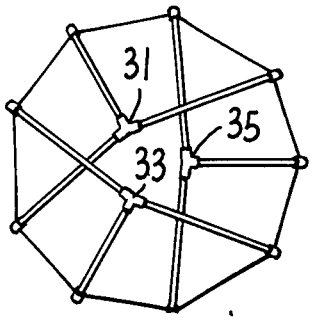
FIG. 3 is a plan view of a tent employing three sets of poles.

In FIG. 3 a similar tent is employed except that here three hubs, namely 31, 33 and 35, are employed. Here again, at least some of the poles cross each other giving a cross-brace effect.

Figure 5:
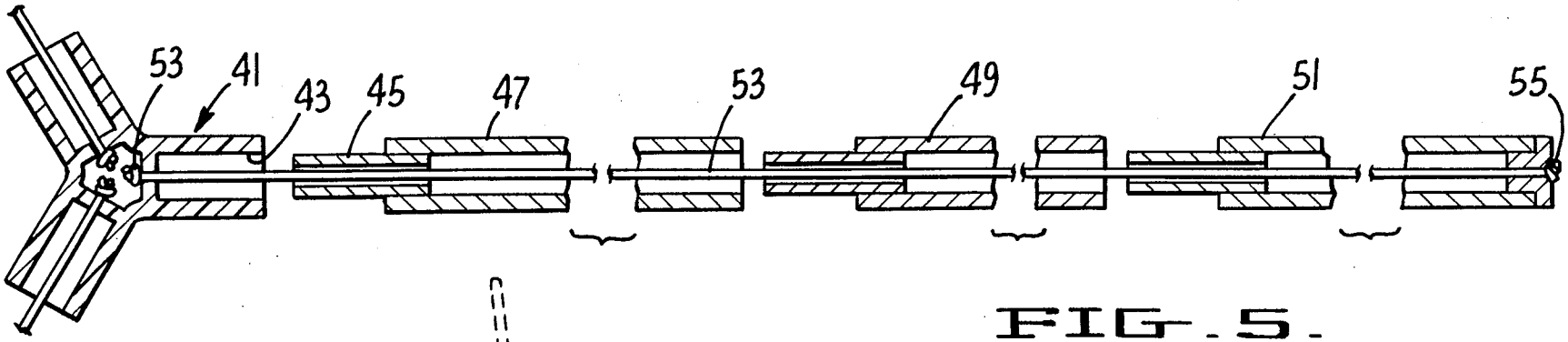
FIG. 5 is an enlarged view in section showing how an elastic cord may be employed to hold the parts together and speed assembly.
Figure 6:
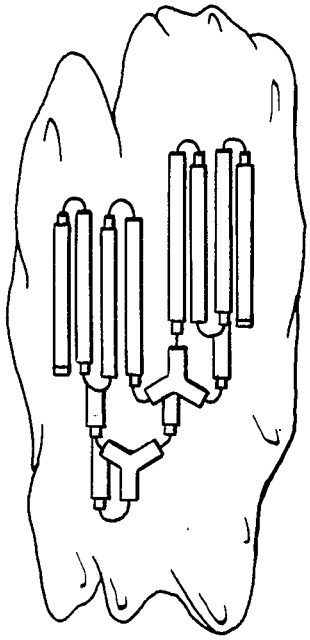
FIG. 6 is a perspective view showing how the poles can be disassembled for transport and held in place for rapid erection of the tent.
Figure 4:
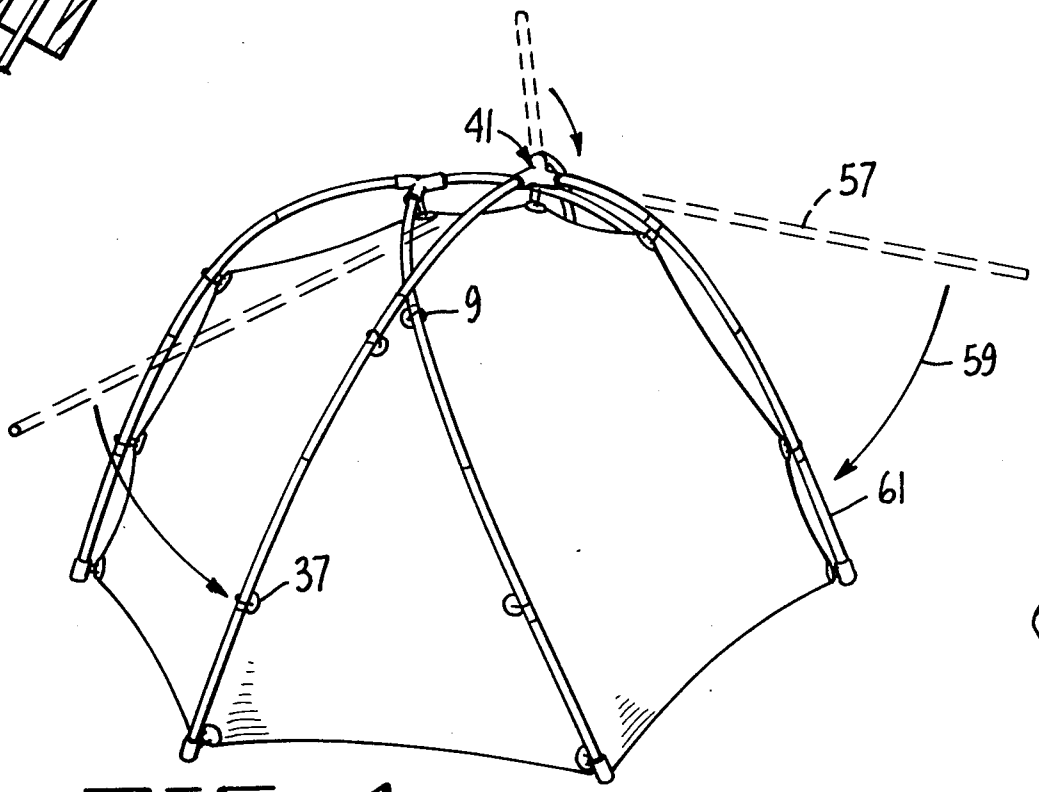
FIG. 4 is a perspective view of another embodiment of the tent wherein clips rather than sleeves are employed.

Referring now particularly to FIGS. 4, 5 and 6, the tent is provided with a plurality of clips as at 37 and 39 rather than the sleeves 27 previously described. Also, each of the poles is made up of relatively short interlocking segments. Thus, referring particularly to FIG. 5, the center hub 41 is provided with an opening 43 in which an end 45 of a pole segment 47 forms a loose friction fit. Similarly, the pole segments 49 and 51 are provided with telescoping end members so that each pole comprises a series of short sections. In accordance with a preferred embodiment of the invention, an elastic cord 53 passes through the hollow centers of the various sections and is anchored at one end on the hub at 53 and at the opposite end on the end pole segment at 55. Thus, when the tent is taken down, as is shown in FIG. 6, the various elements forming the support for the tent are held together in the proper relationship which greatly speeds up assembly of the tent, particularly if the tent is assembled under adverse conditions such as darkness or rain. Also, the elastic cord aids in the assembly of the tent, particularly when the tent is assembled by only one person, as is shown in FIG. 4. Thus as is shown in phantom at 57, a pole is assembled and the elastic cord holds the pole in its assembled position, whereupon it can now be bent around as is shown by arrow 59 to the final position shown in solid lines at 61. Thus, one person can assemble the tent very easily.

I claim:

1. In a dome-like tent structure wherein a membrane is kept under tension primarily by a plurality of stressed arcuate poles attached to said membrane whereby said poles exert a force on said membrane which is radially outward, comprising: a membrane having hem sockets, a multiplicity of rigid hubs with each one having a plurality of hub sockets, each of said rigid hubs removably receiving pole members, each pole member stressed into arcuate shape by the ends thereof captured by said hub sockets and said hem sockets, each pole contacting and being retained by said membrane into a tensioned arch by discrete retention means affixed to said membrane, and at least two poles from each hub crossing another pole from another hub, with said crossing tensioning the membrane between said crossed poles for adding stability to the assembled dome-like tent.

2. In a dome-like tent structure wherein a membrane is kept under tension primarily by a plurality of stressed arcuate poles attached to said membrane whereby said poles exert a force on said membrane which is radially outward, the improvement comprising:

a. at least two sets of poles, each radiating outward from independent spaced, rigid hubs of attachment to the membrane of said tent, each of said hubs having a plurality of holding means for receiving poles and holding said poles in a fixed angular relationship to said hub, b. each pole extending outwardly from a hub and deflected to an arcuate shape downwardly by forces established within the membrane, upon connection with the membrane, to an imaginary plane defining a bottom of said dome-like tent structure, c. at least two of the poles from one set intersecting poles from another set, d. the membrane of the dome constituting the principal connection between adjacent hubs, e. said adjacent hubs being cross-braced with respect to each other by the membrane between the intersecting poles from one set relative to the other and by the membrane between said hubs and by connecting clips between said hubs and membrane, whereby the membrane between said adjacent hubs is tensioned; and f. the holding means on the hubs consisting of a plurality of sockets for receiving and holding of said poles.

3. The structure of claim 2 wherein two hubs are employed with three poles extending outward from each hub.

4. The structure of claim 2 wherein each pole passes through a sleeve attached to the membrane.

5. The structure of claim 4 wherein each pole consists of a plurality of short telescoping segments.

6. The structure of claim 2 wherein each of the poles consists of a hollow short telescoping section with an elastic cord passing through hollow centers of the poles adapted to hold the poles in an assembled position.

7. In a dome-like tent structure wherein a membrane is kept under tension primarily by a plurality of stressed arcuate poles attached to said membrane whereby said poles exert a force on said membrane which is radially outward, the improvement comprising:

at least two sets of poles, each radiating outward from independent spaced, rigid hubs of attachment of the membrane of said tent, each of said hubs having a plurality of socket holding means for receiving poles and holding said poles in a fixed angular relationship to said hub, each pole extending outwardly from a hub and deflected to an arcuate shape downwardly by forces established within the membrane, upon connection with the membrane, to an imaginary plane defining a bottom of said dome-like tent structure, each pole having a plurality of short hollow telescoping segments, elastic means within each of said poles for holding said poles in an assembled position, at least some of the poles from one set intersecting poles from the other set, the membrane of the dome constituting the principal connection between adjacent hubs, and said adjacent hubs being cross-braced with respect to each other by the membrane between the intersecting poles from one set relative to the other and by the membrane between said hubs and by connecting clips between said hubs and membrane, whereby the membrane between said adjacent hubs is tensioned.

8. The structure of claim 7, wherein said elastic means for holding each pole in assembled position comprises an elastic cord passing through the hollow segments of each pole.

9. The structure of claim 8, wherein one end of each elastic cord is secured to the hub for its respective pole.

10. The structure of claim 6, wherein one end of said elastic cord is affixed to the hub for its respective pole.

* * * * *